US007838712B2

(12) United States Patent
Bouvart et al.

(10) Patent No.: US 7,838,712 B2
(45) Date of Patent: Nov. 23, 2010

(54) STEAM-CRACKING OF MODIFIED NAPHTHA

(75) Inventors: François Bouvart, Senlis (FR); Robert Duchesnes, Paris (FR); Claude Gutle, Courbevoie (FR)

(73) Assignees: Total Petrochemicals Research Feluy, Seneffe (Feluv) (BE); Total Raffinage Marketing, Puteaux (FR)

( * ) Notice: Subject to any disclaimer, the term of this patent is extended or adjusted under 35 U.S.C. 154(b) by 1306 days.

(21) Appl. No.: 10/501,266

(22) PCT Filed: Jan. 9, 2003

(86) PCT No.: PCT/FR03/00047

§ 371 (c)(1),
(2), (4) Date: Apr. 11, 2005

(87) PCT Pub. No.: WO03/057802

PCT Pub. Date: Jul. 17, 2003

(65) Prior Publication Data

US 2006/0089518 A1 Apr. 27, 2006

(30) Foreign Application Priority Data

Jan. 10, 2002 (FR) ..... 02 00244

(51) Int. Cl.
*C07C 4/02* (2006.01)
*C10L 1/00* (2006.01)
*C10G 9/36* (2006.01)

(52) U.S. Cl. ..... 585/648; 585/1; 585/259; 585/650; 585/652; 208/14; 208/130; 208/210; 208/211; 208/212; 208/218; 208/227; 208/233; 208/237; 208/DIG. 1

(58) Field of Classification Search ..... 196/110, 196/116; 208/14, 130, 210, 211, 212, 218, 208/227, 233, 237, DIG. 1; 364/501; 422/197, 422/204; 585/259, 648, 1, 650, 652
See application file for complete search history.

(56) References Cited

U.S. PATENT DOCUMENTS

| | | | | | |
|---|---|---|---|---|---|
| 3,511,771 | A | * | 5/1970 | Hamner | 208/89 |
| 3,786,110 | A | | 1/1974 | Oleszko | |
| 4,257,105 | A | * | 3/1981 | Stewart et al. | 700/274 |
| 4,956,509 | A | * | 9/1990 | Harandi et al. | 585/300 |
| 5,124,003 | A | * | 6/1992 | Martens et al. | 196/110 |
| 5,582,714 | A | * | 12/1996 | Forte | 208/237 |
| 6,007,704 | A | * | 12/1999 | Chapus et al. | 208/218 |

FOREIGN PATENT DOCUMENTS

DE 37 08 332 A 9/1988

OTHER PUBLICATIONS

International Search Report dated Jul. 1, 2003.

* cited by examiner

*Primary Examiner*—Prem C Singh
(74) *Attorney, Agent, or Firm*—Sughrue Mion, PLLC

(57) ABSTRACT

Disclosed is a method for steam-cracking naphtha, according to which a charge of hydrocarbons containing a portion of paraffinic naphtha, which is modified by adding a combination of a first component containing a portion of gasoline and a second component containing a portion of at least one hydrocarbonated refinery gas, and a paraffin-rich change containing at least one paraffin selected among propane, butane, or a mixture thereof are fed through a steam cracker in the presence of vapor. Also disclosed is a hydrocarbon composition suitable for steam cracking, containing a portion of a paraffinic naphtha, which is modified by adding a combination of a first component containing a portion of gasoline and a second component containing a portion of at least one hydrocarbonated refinery gas and a paraffin-rich charge containing at least one paraffin selected among propane, butane, or a mixture thereof.

20 Claims, No Drawings

STEAM-CRACKING OF MODIFIED NAPHTHA

The present invention concerns a method for steam-cracking naphtha, a composition of hydrocarbons suitable for steam-cracking, a method for controlling a steam cracker, instrumentation for controlling a steam cracker, and a method for processing a sulfurous gasoline feedstock.

The petrochemical industry requires monomers (building blocks) composed for example of olefins, diolefins and aromatics. In Europe, olefins are primarily obtained by steam-cracking feedstocks obtained from refineries. The available feedstocks are primarily naphtha including paraffins, isoparaffins and aromatics. A naphtha feedstock usable in steam-cracking is known in the industry as including a petroleum fraction the lightest components of which include five carbon atoms and which have a final boiling point of around 200° C., the naphtha including high carbon-index components having a boiling point of at least 200° C. The steam-cracking of naphtha yields light olefins such as ethylene and propylene, and diolefins such as butadiene, as well as gasolines containing aromatics.

When a typical naphtha is subjected to steam-cracking, the cracked product typically has the following composition (in % by weight) when it leaves the furnace:

| | % by weight (approx.) |
|---|---|
| Hydrogen | 1 |
| Methane | 16 |
| Acetylene | 0.2 |
| Ethylene | 22 |
| Ethane | 5 |
| Methylacetylene, Propadiene | 0.3 |
| Propylene | 14 |
| Propane | 0.5 |
| Butadiene | 4 |
| C4 | 5 |
| C5 | 4 |
| Benzene | 9 |
| Toluene | 5 |
| Non-aromatic gasoline | 2 |
| Aromatic gasoline | 6 |
| Fuel oil | 6 |
| Total | 100 |

The most interesting fractions in the cracked product are the light olefins, that is, the ethylene and propylene. Their yield is directly related to the presence of paraffins in the feedstock. When paraffins in straight chains are present, the formation of ethylene is favored. When isoparaffins are present, the formation of propylene is favored. The relative yield in propylene is expressed as the weight ratio of the propylene to the ethylene, and is typically between 0.5 and 0.75.

Recently, because of the increased need for olefins, the supply of the paraffinic naphtha feedstock in a petrochemical plant fed from a refinery has tended to be somewhat limited.

DE-A-3708332 describes a method of thermal cracking ethylene in a steam cracker, where the ethylene is mixed with the naphtha in order to prepare a feedstock composed essentially of naphtha and 10 to 80% by weight ethylene, optionally containing, in addition to the naphtha, fractions from gas-oil (boiling temperature up to 350° C.) and/or recycled byproducts from a petrochemical plant that can have up to 50% naphtha. This method has the disadvantage that it requires relatively large quantities of ethylene (at least 10%) in the raw materials, and the yields of ethylene (compared to the ethylene introduced into the feedstock) and propylene are not particularly high.

U.S. Pat. No. 3,786,110 describes a method of producing unsaturated hydrocarbons obtained by pyrolysis, where the undesirable fractions are reduced by adding to the pyrolysis products a polymerization inhibitor containing asphaltic hydrocarbons.

A method of steam-cracking naphtha capable of furnishing a commercially acceptable yield of olefins, in particular light olefins such as ethylene and propylene, while reducing the quantity of paraffinic naphtha feedstock material required, is therefore necessary in the technology.

Refineries produce a broad range of products. Depending on the technical demands of the local markets and other commercial considerations, some of these products can be of little commercial value and are therefore considered to be "surplus." Currently products like gasolines and certain gaseous hydrocarbons are considered to be obtained in quantities that are too large. Although products of this type can be used in certain petrochemical processes, they are not currently used in steam-cracking operations because, for liquid products, they do not have the required quantity of paraffins.

Ethane and propane are used as feedstocks for steam-cracking, especially in the United States where natural gas, from which they are extracted, is abundant. These paraffins generate a large quantity of ethylene (more than 50%) when they are steam cracked, which results in processing these feed-stocks in units that are specifically sized for this type of feedstock. Some refinery hydrocarbon gases such as FCC gases contain substantial quantities of paraffins (ethane and propane) and olefins (ethylene, propylene). However, when they are steam cracked as such, they have a tendency to generate cracked gaseous effluents having a composition that is different from that of the effluents from steam-cracking normal naphtha. This poses a problem, because it generates an imbalance in the downstream section (especially the distillation columns) of a steam cracker cracking naphtha.

Butane and propane are also used, either alone or in mixture with the naphtha, as feedstock for steam crackers. When they are used exclusively, however, the problem of imbalance in the downstream section of a naphtha steam cracker also becomes apparent. Depending on the availability of the refinery or the market, there can be an excess of these liquefied gases and it is therefore worthwhile to use them as feedstock for a steam cracker.

DE-A-3708332, already cited, does not deal with the technical problem that consists of producing an effluent that has a composition that corresponds with the one produced by steam-cracking naphtha. In the examples of DE-A-3708332, when the ethylene is added (alone) to the naphtha, the composition of the effluent, particularly with regard to ethylene and propylene, is substantially altered as compared to the cracking of naphtha alone under the same conditions, which can result in significantly reducing the capacity of the steam-cracking unit.

A petrochemical process that increases the economic value of the "surplus" refinery products, such as gasolines and gaseous hydrocarbons, is also necessary for the technology.

The invention seeks at least partially to meet these needs.

To that end, the invention proposes a method for steam-cracking naphtha, said method comprising the passage in a steam cracker, in the presence of steam, of a feedstock of hydrocarbons comprising a paraffinic naphtha modified by the addition of the combination of a first component including a gasoline and of a second component including at least one of a hydrocarbon refinery gas and a feedstock rich in paraffins including at least one paraffin selected from propane and butane or a mixture thereof.

The invention also proposes a composition of hydrocarbons appropriate for steam-cracking, comprising a paraffinic naphtha modified by the addition of the combination of a first component including a gasoline, and of a second component including at least one of a hydrocarbon refinery gas and a feed-stock rich in paraffins including at least one paraffin selected from propane and butane or a mixture thereof.

The invention also proposes a method for controlling a steam cracker, said method comprising the supply to a steam cracker of steam and of a feed-stock of hydrocarbons comprising a paraffinic naphtha modified by the addition of the combination of a first component including a gasoline, and of a second component including at least one of a hydrocarbon refinery gas and a feed-stock rich in paraffins including at least one paraffin selected from propane and butane or a mixture thereof, and the continuous control of the supply of paraffinic naphtha, of the second component and of the gasoline in the feedstock, in order to give the effluent a desired target composition.

Moreover, the invention proposes an instrumentation for controlling a steam cracker, said instrumentation comprising means of furnishing a steam cracker with a hydrocarbon feedstock comprising a paraffinic naphtha modified by the addition of the combination a gasoline and of at least one of a hydrocarbon refinery gas and/or butane or propane or a mixture thereof, and means for continuously controlling the proportions of the paraffinic naphtha, of the refinery gas and/or of butane or propane or the mixture thereof, and of the gasoline in the feedstock, in order to give the effluent a desired target composition.

The invention also proposes a method for processing a feedstock of sulfurous gasoline, which method includes the following phases: combining a sulfurous gasoline feedstock with a naphtha feedstock to obtain a composite feed-stock; causing the composite feedstock to pass into a steam cracker, in the presence of steam, to produce an effluent, the effluent containing at least light olefins, the light olefins having at least one olefin between C2 and C4, and C5+ hydrocarbons; and separating from the effluent a first fraction that is practically free of sulfur and includes the light olefins, and a second fraction that contains sulfur and includes the C5+ hydrocarbons.

The invention is based on the surprising discovery by the Applicant that by selecting certain quantities and qualities of these gasolines and gaseous hydrocarbons and by using them as feedstocks in combination with naphtha, it is possible to steam crack the composite feedstock in order to produce a composition for the cracked product (called "pallet of products" in the industry) which strongly resembles a pallet of products resulting from the steam-cracking, under similar conditions, of a feedstock of just paraffinic naphtha. The composition of the effluent produced according to the invention falls within a range of ±90%, and preferably ±0% by weight, for each component, compared to that of the effluent, when said effluent is non-modified paraffinic naphtha.

In reality, therefore, according to the invention part of the paraffinic naphtha feedstock is replaced by a combination of a gasoline feedstock and a hydrocarbon refinery gas feedstock and/or a butane or propane feedstock or mixture of the two.

This offers the combined advantages of (a) reducing the quantity of paraffinic naphtha feeds needed for the steam-cracking process, and (b) using the gaseous hydrocarbon products and "surplus" gasoline products in the steam-cracking process to produce products that are economically beneficial and useful, to wit, light olefins, while making only minor modifications to the steam-cracking unit since the overall balance of materials is only slightly modified.

Forms of embodiment of the invention will now be described, solely by way of example, with reference to the appended drawing in which:

FIG. 1 diagrammatically shows a unit for the steam-cracking of feedstocks containing naphtha according to one form of embodiment of the invention.

According to the invention, a method for the steam-cracking of naphtha uses a feedstock composed of hydrocarbons, comprising a paraffinic naphtha modified by a gasoline in combination with a hydrocarbon refinery gas and/or butane or propane or a mixture thereof.

The paraffinic naphtha to be used in the method of the invention includes 10 to 60% by weight of n-paraffins, 10 to 60% by weight of isoparaffins, 0 to 35% by weight of naphthenes, 0 to 1% by weight of olefins and 0 to 20% by weight of aromatics. A typical paraffinic naphtha to be used in the method of the invention includes about 31% by weight of n-paraffins, 35% by weight of isoparaffins (giving a total paraffinic content of 66% by weight), 26% by weight of naphthenes, 0% by weight of olefins (typically 0.05% by weight of olefins) and 8% by weight of aromatics.

According to the invention, this starting feedstock of paraffinic naphtha is modified by adding to it a gasoline and a hydrocarbon refinery gas and/or butane or propane or a mixture thereof.

The gasoline is preferably a fraction from an FCC (fluidized-bed catalytic cracking) unit of an oil refinery (hereinafter called FCC gasoline), which advantageously has not been given a hydrogenation treatment (called "hydro-refining" in the industry), which increases the paraffins content of the gasoline by hydrogenating the unsaturated functions (like those present in the olefins and diolefins) of the gasoline. The advantage of using a non-hydro-refined FCC gasoline is that by avoiding a hydrogenation process, production costs are reduced by eliminating or reducing the use of hydrogen and by avoiding the need for additional hydro-refining capacity.

The FCC gasoline is a fraction or a mixture of fractions from the FCC unit typically having a distillation range of between 30 and 160° C., preferably a fraction or mixture of fractions that reach boiling in a range of between 30 and 65° C., 65 to 105° C. and 105 to 145° C. The choice of the particular FCC gasoline or mixture thereof to be used can be determined based on the requirements at any time for the various fractions produced by the refinery. For example, some gasoline fractions have an octane deficit and could be better upgraded in a steam cracker rather than having to increase the octane index in the refinery. In addition, the FCC gasoline to be used can have a sulfur content that would be too high for gasolines to be used in automobiles and would require hydrogen desulfurization treatment, which is costly because it consumes hydrogen and requires the corresponding capacity on a desulfurization unit.

It is preferable to use a non-hydrorefined FCC gasoline because, in the refinery, where there is a need for hydrorefined gasoline for other uses, this can cause bottlenecks in the processing by the hydro-refining unit. By reducing the quantity of non-hydro-refined gasoline present in the refinery, that is, by consuming the non-hydro-refined gasoline in the steam-cracking process of the invention, the hydro-refining equipment and units can be unblocked, thus improving the management of flows in the refinery while reducing the needs for hydrogen.

Typically the non-hydro-refined FCC gasoline includes from 0 to 30% by weight of n-paraffins, from 10 to 60% by weight of isoparaffins, from 0 to 80% by weight of naphthenes, from 5 to 80% by weight of olefins and from 0 to 60% by weight of aromatics. More typically, the non-hydrorefined FCC gasoline includes approximately 3.2% by weight of n-paraffins, 19.2% by weight of isoparaffins (giving a total paraffins content of 22.4% by weight), 18% by weight of naphthenes, 30% by weight of olefins and 29.7% by weight of aromatics.

However, if a hydro-refined FCC gasoline were used, a substantial quantity of hydrogen would be needed to hydrogenate it and the hydrorefined composition would resemble typical naphtha used for steam-cracking.

With regard to the hydrocarbon refinery gas that is added, in combination with the FCC gasoline and/or the butane or propane or a mixture of the two, to the paraffinic naphtha to produce a composite feedstock for the steam-cracking, this hydrocarbon gas is rich in $C_2$ and $C_3$ hydrocarbons, particularly in paraffins (ethane and propane) and in olefins (ethylene and propylene). Preferably the refinery gas has the following composition ranges: 0 to 5% by weight of hydrogen, 0 to 40% by weight of methane, 0 to 50% by weight of ethylene, 0 to 80% by weight of ethane, 0 to 50% by weight of propylene, 0 to 80% by weight of propane and 0 to 30% by weight of butane. A typical composition of refinery gas of this type is approximately 1% by weight of hydrogen, 2% by weight of nitrogen, 0.5% by weight of carbon monoxide, 0% by weight of carbon dioxide, 10% by weight of methane, 15% by weight of ethylene, 32% by weight of ethane; 13% by weight of propylene, 14% by weight of propane, 2% by weight of isobutane, 4% by weight of n-butane, 3% by weight of butene, 2% by weight of n-pentane, and 1.5% by weight of n-hexane.

With regard to the butane and/or propane or the mixture thereof that is added to the paraffinic naphtha, in combination with the FCC gasoline and optionally the refinery gas, in order to produce a composite feedstock for steam-cracking, this butane and/or propane or the mixture thereof can contain olefinic compounds such as butenes and/or propylene, or saturated compounds such as butanes (normal and/or iso) and/or propane. Preferably the butane and/or propane or the mixture thereof contain more than 50% by weight of saturated compounds in order to maximize the production of light olefins such as ethylene and propylene. The butane and propane are preferably n-butane and n-propane.

According to the method of the invention, the parts of naphtha, refinery gas, butane or propane or a mixture thereof, and gasoline are combined to form a composite feedstock that is then processed by steam-cracking. Preferably, the composite feedstock includes from 5 to 95% by weight of naphtha, 5 to 95% by weight of a mixture of refinery gas, butane or propane or a mixture of thereof, and gasoline. Typically, the mixture of refinery gas, butane or propane or a mixture thereof, and gasoline that is added to the naphtha includes up to 60% by weight of refinery gas and/or butane or propane or a mixture thereof, and at least 40% by weight of gasoline, more typically up to 50% by weight of refinery gas and/or butane or propane or a mixture thereof, and up to 50% by weight of gasoline. In a more preferred manner, the naphtha composite includes 80% by weight of naphtha, 7% by weight of refinery gas and/or butane or propane or a mixture thereof, and 13% by weight of non-hydrorefined FCC gasoline.

The composite feedstock of naphtha, gasoline, refinery gas and/or butane or propane or a mixture thereof, is typically processed by steam-cracking under conditions similar to those known in the industry, to wit, at a temperature of between 780 and 880° C., preferably between 800 and 850° C. The quantity of steam can also fall within a range known in the industry, typically between 25 and 60% by weight on the basis of the weight of the hydrocarbon feedstock.

With reference to FIG. 1 of the appended drawing, the hot section of a steam cracking unit to be used in the method of the invention is represented diagrammatically. The steam cracking unit, generally indicated by 2, includes a heating unit composed of furnaces 4, which are provided with coils 6 having a first intake 8 for the feedstock of hydrocarbons to be cracked and a second intake 10 for the steam. An outlet conduit 12 from the heating unit is connected to a first fractionating column 14. The first fractionating column 14 includes a gasoline reflux 15 and outlets for the various fractionated products, including a top outlet 16 for the light hydrocarbons and a bottom outlet 18 for the heavy hydrocarbons, which can be returned through 19 after cooling in the conduit 12 in order to control the temperature or drawn off at 17 in the form of heavy products called pyrolysis oil.

In this simplified description and in the presentation of the following examples, only the feeds from outside the steam cracker, commonly called fresh feeds, are considered, and not the possible recycling of products coming from the steam cracker itself, such as ethane, which is often re-cracked until it disappears.

If desired, the entire composite feedstock of naphtha, refinery gas and/or butane or propane or a mixture of the two, and gasoline can be fed through the common intake 8 of hydrocarbons, or alternatively, the four components naphtha, FCC gasoline, refinery gas and/or butane or propane or a mixture thereof can be cracked separately in specific tubular coils. In one particular form of embodiment, the naphtha and the FCC gasoline, for the one part, the butane and/or propane or a mixture of the two, and the refinery gas, for the other part, are cracked separately. The reason for this is that the naphtha and the FCC gasoline are typically cracked a temperatures that are close to each other, typically within the range of 750 to 850° C., while the butane, propane and refinery gases that contain the ethane and propane should be cracked at higher temperatures, typically within the range of 800 to 900° C. The two effluents can be combined at the outlet of the heating unit before the first fractionating column.

The method of the invention can function continuously and offers the advantage of eliminating the excess gasoline from the refinery, and also reducing the need at the refinery for a desulphurization process. The gasoline contains sulfur, and after the steam-cracking process, in which the gasoline furnishes part of the feedstock, the most-interesting light olefins in the effluent are free of sulfur, while the sulfur remains concentrated in the C5+ part of the effluent flow. Consequently the use of gasoline as part of a feedstock to be steam cracked to produce the lightest olefins leads to a partial desulfurization of the gasoline portion of the feedstock, because the sulfur is concentrated in the fraction with the highest carbon number and of least commercial interest of the effluent, to wit, the C5+ flow.

In a related way, according to another aspect, the invention proposes a method for processing a sulfurous gasoline feedstock, which method comprises the following phases: combining a sulfurous gasoline feedstock with a naphtha feedstock to provide a composite feedstock; causing the composite feedstock to pass through a steam cracker, in the presence of steam, to produce an effluent, the effluent containing at least light olefins, the light olefins having at least one of the C2 to C4 olefins, and C5+ hydrocarbons; and separating from the effluent a first fraction that is practically free of sulfur and includes the light olefins, and a second fraction that contains the sulfur and includes the C5+ hydrocarbons. In this way, the sulfur is redistributed in the higher carbon number fraction, producing a lower carbon number olefinic fraction free of sulfur, which is an effective way to partially desulfurize the gasoline feedstock.

Moreover, the method offers the advantage that the steam-cracking process at least partially dehydrogenates the ethane present in the refinery gas, the dehydrogenation being accomplished at a temperature high enough to effectively produce ethylene.

The invention also offers the advantage that by adding to the feedstock naphtha that contains no olefins or only a small quantity thereof, non-hydro-refined gasoline that contains a relatively high quantity of olefins, typically from 5 to 80% by weight of olefins; the composite feedstock for the steam-cracking has a higher overall content of olefins compared to the naphtha alone, and this results in a lower use of energy to produce light olefins (that is, ethylene and propylene) from this feedstock, compared to steam-cracking paraffins or paraffinic feedstocks into light olefins of this type.

According to another aspect of the invention, a software program, using linear or non-linear programming, is used to continuously control the steam-cracking conditions, in particular to control the parts of the paraffinic naphtha, the refinery gas, the butane and/or propane or the mixture of the two, and the FCC gasoline in the feedstock, so that the effluent has the desired target composition. For example, the target composition can have appreciably the same effluent composition for the important components, that is, ±20% by weight, preferably ±10% by weight compared to that of the unmodified feedstock. The software can also control the flow of the refinery gas and/or control the quantities of FCC gasoline and/or butane or propane or mixture of the two, taken from the refinery for shipment of excess quantities, for example, to storage tanks.

The invention will now be described in more detail with reference to the following two examples.

Example 1

In this example, a composite feedstock having 80% by weight naphtha and 20% mixture of refinery gas and non-hydrorefined FCC gasoline, at a ratio by weight one third gas and two thirds gasoline, was subjected to steam-cracking.

The naphtha has the following approximate starting composition:

31% by weight n-paraffins,
35% by weight isoparaffins (giving a total paraffinic content of 66% by weight),
26% by weight naphtalenes,
0.05 wt olefins,
0% by weight diolefins,
8% by weight aromatics.

The refinery gas has the following approximate starting composition:

1% by weight hydrogen,
2% by weight nitrogen,
0.5% by weight carbon monoxide,
0% by weight carbon dioxide,
10% by weight methane,
15% by weight ethylene,
32% by weight ethane,
13% by weight propylene,
14% by weight propane,
2% by weight isobutane,
4% by weight n-butane,
3% by weight butene,
2% by weight n-pentane,
1.5% by weight n-hexane.

The non-hydro-refined FCC gasoline has the following approximate starting composition:

3% by weight n-paraffins,
19% by weight isoparaffins (giving a total paraffinic content of 22% by weight),
18% by weight naphthenes,
30% by weight olefins,
30% by weight aromatics.

After steam-cracking, the overall effluent from the set of furnaces at outlet 12 without recycling the ethane produced by the steam cracker, has the composition shown in Table 1.

TABLE 1

Composition of the Effluent of Example 1

| | % by weight (approx.) |
|---|---|
| $H_2$ | 0.9 |
| Methane | 16.0 |
| Acetylene | 0.2 |
| Ethylene | 22.0 |
| Ethane | 5.3 |
| Methylacetylene-propadiene | 0.3 |
| Propane | 0.6 |
| Propylene | 12.5 |
| Butadiene | 3.4 |
| C4 | 4.4 |
| C5 | 3.8 |
| Benzene | 8.9 |
| Toluene | 6.3 |
| Non-aromatic gasoline | 2.0 |
| Aromatic gasoline | 6.9 |
| Fuel oil | 6.5 |

By contrast, when 100% of the same naphtha is subjected to steam-cracking under the same conditions, the effluent obtained had the composition shown in Table 2.

TABLE 2

| | Naphtha | Refinery Gas | Non-hydro-refined FCC gasoline |
|---|---|---|---|
| Hydrogen | 0.8 | 2.6 | 0.6 |
| Methane | 15.2 | 27.4 | 13.6 |
| Acetylene | 0.2 | 0.2 | 0.1 |
| Ethylene | 21.8 | 43.5 | 12.5 |
| Ethane | 5.0 | 12.5 | 3.1 |
| MAPD | 0.4 | 0.1 | 0.3 |
| Propylene | 14.2 | 2.7 | 7.5 |
| Propane | 0.6 | 0.5 | 0.3 |
| Butadiene | 3.7 | 1.7 | 2.2 |
| C4 | 5.1 | 0.4 | 2.5 |
| C5 | 4.3 | 0.6 | 2.2 |
| Benzene | 9.1 | 3.8 | 10.0 |
| Toluene | 5.4 | 0.5 | 14.9 |
| Non-aromatic gasoline | 2.4 | 0.1 | 1.1 |
| Aromatic gasoline | 5.8 | 1.4 | 16.8 |
| Fuel oil | 6.0 | 2.0 | 12.3 |

As can be seen, the effluent resulting from the steam-cracking of the combination of three feedstocks of paraffinic naphtha, refinery gas and non-hydro-refined FCC gasoline very strongly resembles the effluent produced by steam-cracking paraffinic naphtha alone.

Thus, the composition of the effluent from the composite feedstock of Example 1 is similar (±10% by weight for each component) to that of naphtha alone, but part of the naphtha has been replaced by the addition of the refinery gas and the FCC gasoline for the reasons and advantages indicated above. It can be seen that the high yields of ethylene and propylene obtained by the method according to the invention are similar to those that can be obtained simply by steam-cracking paraffinic naphtha.

Table 2 also shows, by contrast, the compositions of the effluents obtained by steam-cracking of refinery gas alone, and separately, the FCC gasoline alone. As can be seen, the steam-cracking of the non-hydro-refined FCC gasoline produces a low yield of ethylene and propylene, and the steam-cracking of refinery gas produces a high yield of ethylene, but a low yield of propylene. However, when the three feedstocks of naphtha, refinery gas and non-hydro-refined FCC gasoline are combined, the composition of the effluent very strongly resembles that of normal naphtha.

Example 2

In this example, a composite feedstock having 60% by weight naphtha and 40% by weight mixture of butane and non-hydro-refined FCC gasoline, in a ratio by weight half gas and half gasoline, is subjected to steam cracking.

The naphtha has the same starting composition as in the preceding example.

The butane in this example is normal pure butane, as can be produced at the output of a refinery alkylation unit.

The non-hydro-refined FCC gasoline has the same starting composition as in the preceding example.

After steam cracking, the overall effluent from the set of furnaces at outlet 12 without recycling the ethane produced by the steam cracker has the composition shown in Table 3.

TABLE 3

Composition of the Effluent of Example 2

| | % by weight (approx.) |
|---|---|
| $H_2$ | 0.8 |
| Methane | 15.4 |
| Acetylene | 0.2 |
| Ethylene | 21.9 |
| Ethane | 4.8 |
| Methylacetylene-propadiene | 0.4 |
| Propylene | 14.1 |
| Propane | 0.5 |
| Butadiene | 3.2 |
| C4 | 5.9 |
| C5 | 3.7 |
| Benzene | 7.7 |
| Toluene | 6.3 |
| Non-aromatic gasoline | 2.1 |
| Aromatic gasoline | 6.9 |
| Fuel oil | 6.1 |

By contrast, when 100% of the same naphtha was subjected to steam-cracking under the same conditions, the effluent obtained had the composition shown in Table 2 and recalled in Table 4.

TABLE 4

| | Naphtha | Butane | Non-hydro-refined FCC gasoline |
|---|---|---|---|
| Hydrogen | 0.8 | 0.9 | 0.6 |
| Methane | 15.2 | 18.8 | 13.6 |
| Acetylene | 0.2 | 0.4 | 0.1 |
| Ethylene | 21.8 | 32.7 | 12.5 |
| Ethane | 5.0 | 5.9 | 3.1 |
| MAPD | 0.4 | 0.3 | 0.3 |
| Propylene | 14.2 | 19.7 | 7.5 |
| Propane | 0.6 | 0.4 | 0.3 |

TABLE 4-continued

| | Naphtha | Butane | Non-hydro-refined FCC gasoline |
|---|---|---|---|
| Butadiene | 3.7 | 2.8 | 2.2 |
| C4 | 5.1 | 11.2 | 2.5 |
| C5 | 4.3 | 2.2 | 2.2 |
| Benzene | 9.1 | 2.2 | 10.0 |
| Toluene | 5.4 | 0.6 | 14.9 |
| Non-aromatic gasoline | 2.4 | 0.8 | 1.1 |
| Aromatic gasoline | 5.8 | 0.5 | 16.8 |
| Fuel oil | 6.0 | 0.6 | 12.3 |

As can be seen, the effluent resulting from the steam-cracking of the combination of three feedstocks of paraffinic naphtha, butane and non-hydro-refined FCC gasoline very strongly resembles the effluent produced by steam-cracking paraffinic naphtha alone.

Thus, the composition of the effluent from the composite feedstock of Example 2 is similar (±10% by weight for each component) to that of naphtha alone, but part of the naphtha has been replaced by the addition of butane and FCC gasoline for the reasons and advantages indicated above. It can be seen that the high yields of ethylene and propylene obtained by the method according to the invention are similar to those that can be obtained simply by steam-cracking paraffinic naphtha.

Table 4 also shows, by contrast, the compositions of the effluents obtained by steam cracking of butane alone, and separately, the FCC gasoline alone. It can be seen that the steam-cracking of the non-hydro-refined FCC gasoline produces a low yield of ethylene and propylene, and that the steam-cracking of butane produces a high yield of ethylene, propylene and C4, and low yields of heavy products. However, when the three feedstocks of naphtha, butane and non-hydro-refined FCC gasoline are combined, the composition of the effluent very strongly resembles that of normal naphtha.

The invention claimed is:

1. A method for steam-cracking naphtha comprising passing a feedstock of hydrocarbons through a steam cracker, in the presence of steam;

wherein said feedstock of hydrocarbons comprises about 60% to about 80% by weight of a paraffinic naphtha, and about 40% to about 20% by weight of a mixture of a first component, that is, a gasoline produced by a fluidized bed catalytic cracking (FCC) unit and a second component including at least one hydrocarbon refinery gas and at least a feedstock rich in paraffins, the paraffinic naphtha having from 10 to 60% by weight of n-paraffins, from 10 to 60% by weight of isoparaffins, from 0 to 35% by weight of naphthenes, from 0 to 1% by weight of olefins, and from 0 to 20% by weight of aromatics, the FCC gasoline being an unhydrogenated gasoline having from 0 to 30% by weight of n-paraffins, from 10 to 60% by weight of isoparaffins, from 0 to 80% by weight of naphthenes, from 5 to 80% by weight of olefins and from 0 to 60% by weight of aromatics, the refinery gas having from 0 to 5% by weight of hydrogen, from 0 to 40% by weight of methane, from 0 to 50% by weight of ethylene, from 0 to 80% by weight of ethane, from 0 to 50% by weight of propylene, from 0 to 80% by weight of propane and from 0 to 30% by weight of butanes, and the feedstock rich in paraffins containing at least 50% by weight of saturated hydrocarbons, said feedstock containing at least propane or butane.

2. The method according to claim 1, in which the mixture of the first and second components that is added to the naphtha includes up to 60% by weight of the second component and at least 40% by weight of gasoline.

3. The method according to claim 2, in which the mixture of the first and second components includes up to 50% by weight of the second component and at least 50% by weight of gasoline.

4. The method according to claim 2 or 3, in which the mixture of the first and second components includes about one third in percentage by weight of the second component and about two thirds in percentage by weight of gasoline.

5. The method according to any one of claims 1-3, in which the feedstock includes about 80% by weight naphtha, about 7% by weight of the second component and about 13% by weight of gasoline.

6. The method according to any one of claims 1-3, in which the FCC gasoline is a fraction or a mixture of fractions from an FCC unit having a distillation range of between 30 and 160° C.

7. The method according to any of claims 1 to 3, in which the second component consists of at least propane and butane.

8. The method according to any of claims 1 to 3, in which the composite feedstock of naphtha, gasoline and of the second component is subjected to steam-cracking under conditions including a temperature of between 780 and 880° C.

9. The method according to any of claims 1 to 3, in which the quantity of steam is from 25 to 60% by weight based on the weight of the feedstock of hydrocarbons.

10. A composition of hydrocarbons suitable for a steam-cracking method, said composition comprising about 60% to about 80% by weight of a paraffinic naphtha and about 40% to about 20% by weight of a mixture of a first component, that is, a gasoline produced by a fluidized bed catalytic cracking (FCC) unit and a second component including at least one hydrocarbon refinery gas and at least a feedstock rich in paraffins, the paraffinic naphtha having from 10 to 60% by weight of n-paraffins, from 10 to 60% by weight of isoparaffins, from 0 to 35% by weight of naphthenes, from 0 to 1% by weight of olefins and from 0 to 20% by weight of aromatics, the FCC gasoline being an unhydrogenated gasoline having from 0 to 30% by weight of n-paraffins, from 10 to 60% by weight of isoparaffins, from 0 to 80% by weight of naphthenes, from 5 to 80% by weight of olefins and from 0 to 60% by weight of aromatics, the refinery gas having from 0 to 5% by weight of hydrogen, from 0 to 40% by weight of methane, from 0 to 50% by weight of ethylene, from 0 to 80% by weight of ethane, from 0 to 50% by weight of propylene, from 0 to 80% by weight of propane and from 0 to 30% by weight of butanes, and the feedstock rich in paraffins containing at least 50% by weight of saturated hydrocarbons, said feedstock containing at least propane or butane.

11. The composition of hydrocarbons according to claim 10, in which the mixture of the first and second components to the naphtha includes up to 60% of the second component and at least 40% by weight gasoline.

12. The composition of hydrocarbons according to claim 11, in which the mixture of the first and second components includes up to 50% of the second component and at least 50% by weight of gasoline.

13. The composition of hydrocarbons according to claim 11 or 12, in which the mixture of the first and second components that is added to the naphtha includes about one third in percentage by weight of the second component and about two thirds in percentage by weight of gasoline.

14. The composition of hydrocarbons according to claim 13, in which the feedstock includes about 80% by weight of naphtha, about 7% by weight of the second component and about 13% by weight of gasoline.

15. The composition of hydrocarbons according to any of claims 10 to 12, in which the second component consists of at least propane and butane.

16. A method for controlling a steam cracker, said method comprising:

supplying steam and a feedstock of hydrocarbons to a steam cracker;

wherein the feedstock of hydrocarbons comprises about 60% to about 80% by weight of a paraffinic naphtha and about 40% to about 20% by weight of a mixture of a first component, that is, a gasoline produced by a fluidized bed catalytic cracking (FCC) unit, and a second component including at least one hydrocarbon refinery gas and at least a feedstock rich in paraffins, the paraffinic naphtha having from 10 to 60% by weight of n-paraffins, from 10 to 60% by weight of isoparaffins, from 0 to 35% by weight of naphtalenes, from 0 to 1% by weight of olefins and from 0 to 20% by weight of aromatics, the FCC gasoline being an unhydrogenated gasoline having from 0 to 30% by weight of n-paraffins, from 10 to 60% by weight of isoparaffins, from 0 to 80% by weight of naphthenes, from 5 to 80% by weight of olefins and from 0 to 60% by weight of aromatics, the refinery gas having from 0 to 5% by weight of hydrogen, from 0 to 40% by weight of methane, from 0 to 50% by weight of ethylene, from 0 to 80% by weight of ethane, from 0 to 50% by weight of propylene, from 0 to 80% by weight of propane and from 0 to 30% by weight of butanes, and the feedstock rich in paraffins containing at least 50% by weight of saturated hydrocarbons, said feedstock containing at least propane or butane; and a continuous control of the supply of paraffinic naphtha, of the second component and of the gasoline in the feedstock, in order to give an effluent a desired target composition.

17. The method according to claim 16, in which the target composition is appreciably the same composition of effluent, that is ±20% by weight for any given effluent component, as the composition obtained with unmodified paraffinic naphtha.

18. The method according to claim 16 or 17, in which the second component and the gasoline are both furnished directly by a refinery and also including control of sending the second excess component to the flare and/or the control of the quantity of gasoline in the refinery.

19. The method according to any one of claims 16 to 17, in which the supply of the components of the feedstock to the steam cracker is controlled by software.

20. The method according to claim 1 or 16 for processing sulfurous gasoline wherein sulfurous gasoline produced by a fluidized bed catalytic cracking unit, and effluent from the steam cracker containing at least light olefins, which have at least one olefin between C2 and C4, and C5+ hydrocarbons, are separated into a first fraction, which is practically free of sulfur and includes the light olefins, and a second fraction that contains sulfur and includes the C5+ hydrocarbons.

* * * * *